United States Patent [19]

Johnson et al.

[11] Patent Number: 4,832,907

[45] Date of Patent: May 23, 1989

[54] PROCESS FOR PRODUCING TUNGSTEN HEAVY ALLOY SHEET

[75] Inventors: Walter A. Johnson, Towanda; Preston B. Kemp, Jr., Athens; James R. Spencer, Sayre, all of Pa.

[73] Assignee: GTE Products Corporation, Stamford, Conn.

[21] Appl. No.: 143,866

[22] Filed: Jan. 14, 1988

[51] Int. Cl.[4] ..... G22F 1/00

[52] U.S. Cl. ..... 419/36; 75/248; 419/40; 419/43; 419/47; 419/58

[58] Field of Search ..... 75/248; 419/36, 40, 419/47, 43, 58

[56] References Cited

U.S. PATENT DOCUMENTS 4,602,954 7/1986 Davies et al. ..... 419/47

4,744,944 5/1988 Spencer et al. ..... 419/47

*Primary Examiner*—Stephen J. Lechert, Jr.

*Attorney, Agent, or Firm*—Donald R. Castle; L. Rita Quatrini

[57] ABSTRACT

A process is disclosed for producing a sheet of tungsten heavy alloy which involves uniformly blending elemental powder components of the alloy by forming a slurry of the powder components in a liquid medium, removing the liquid medium from the powders and forming a planar cake of the powders, drying the cake, sintering the cake to a density equal to or greater than about 90% of the theoretical density of the alloy to form the sheet.

3 Claims, No Drawings

PROCESS FOR PRODUCING TUNGSTEN HEAVY ALLOY SHEET

CROSS REFERENCE TO RELATED APPLICATIONS

This invention is related to the following applications: attorney's docket D-87-2-053, entitled "Process For Producing Tungsten Heavy Alloy Sheet Using A Metallic Salt Binder", Ser. No. 143878, D-87-2-054 entitled "Process For Producing Tungsten Heavy Alloy Sheet Using Hydrometallurgically Produced Tungsten Heavy Alloy", Ser. No. 143864, D-87-2-176 entitled "Process For Producing Tungsten Heavy Alloy Sheet By Direct Hydrometallurgical Process," Ser. No. 143873, D-87-2-055 entitled "Process For Producing Tungsten Heavy Alloy Sheet Using High Temperature Processing Techniques", Ser. No. 143869 and D-87-2-196 entitled "Process For Producing Tungsten Heavy Alloy Sheet By A Loose Fill Hydrometallurgical Process", Ser. No. 143865, all of which are filed concurrently herewith and all of which are assigned to the same assignee as the present application.

This invention relates to a process for producing tungsten heavy alloy sheet in which a sintered cake is first formed which is substantially close in thickness to the final thickness of the rolled sheet.

BACKGROUND OF THE INVENTION

Tungsten heavy alloy sheet can be produced by rolling sintered slabs of the alloy. Because the rolling requires numerous anneals it is desirable that the starting slab be no more than about twice the final thickness. One method to produce these slabs is by isostatically pressing the powder alloy blends and sintering them to full density. With thin slabs it is difficult to get a uniform fill of the mold so the resulting slabs are not uniform in thickness. There is also a problem with breakage with the thin slabs. Using this method it is not possible to produce slabs with a surface area to thickness ratio much over 600 or thickness less than about 0.5".

Another method of making tungsten heavy alloy sheet is to press large billets and cut the green billet into thin slabs. While this process produces slabs of uniform thickness it has the size limitations of the previous method and there is the added expense of cutting.

It would be desirable to make a sheet preform substantially close in thickness to the final thickness of the rolled sheet. This would reduce the time, energy, and labor required for hot rolling and annealing.

SUMMARY OF THE INVENTION

In accordance with one aspect of this invention, there is provided a process for producing a sheet of tungsten heavy alloy which involves uniformly blending elemental powder components of the alloy by forming a slurry of the powder components in a liquid medium, removing the liquid medium from the powders and forming a planar cake of the powders, drying the cake, sintering the cake to a density equal to or greater than abaout 90% of the theoretical density of the alloy to form the sheet.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The process of the present invention relates to formation of a planar cake of the component powders of the tungsten heavy alloy. This cake can then be processed to form a sintered sheet which is substantially close in thickness to the final thickness of the rolled sheet. As a result of formation of this type of cake, there is a reduction in the time, energy and labor required for hot rolling and annealing.

Some tungsten heavy alloys which are especially suited to this invention, although the invention is not limited to these, are tungsten-iron-nickel alloys especially those in which the Ni:Fe weight ratio is from about 1:1 to about 9:1 and most preferably about 8:2. As an example of these preferred alloys are those having the following composition in percent by weight: about 8% Ni, 2% Fe, and the balance W, about 4 % Ni, about 1 % Fe, and the balance W, and about 5.6% Ni, about 1.4% Fe, and the balance W. The alloys can be with or without additions of Co and/or Cu.

The elemental metal powder components of the alloy are first uniformly blended. This is done by forming a slurry of the powders in a liquid medium. The liquid medium can be water or organic solvents, which can be oxygen containing or non-oxygen containing organic solvents. Typical oxygen containing organic solvents are alcohols, one in particular being a reagent alcohol which is about 90% by weight ethyl alcohol, about 5% by weight methyl alcohol, and about 5% by weight isopropyl alcohol. Other solvents that can be used are alkane hydrocarbon liquids and chlorinated hydrocarbon liquids. The slurry can have other components such as organic or inorganic binders, etc. The actual formation of the slurry can be done by standard methods.

The liquid medium is then removed from the powders. This is done in such a way so that the powders form into a planar cake which is substantially close in thickness to the thickness of the final rolled sheet. The thickness of the sheet is typically from about 0.1" to about 0.5" after sintering and before rolling. By a planar cake is meant that the cake is uniform in thickness and density and is uniform in composition across the length and width of the cake. At this point, the composition of the cake may not be completely uniform throughout the thickness because tungsten powder would tend to settle faster than the other components. However, during the subsequent sintering step, compositional variations essentially disappear and the composition becomes substantially uniform throughout its thickness. The preferred methods of forming the planar cake are by using a porous filter medium and applying vacuum, gas pressure, or mechanical pressure. Vibration can also be used if this is desirable. The liquid removal can be accomplished by batch or continuous processing.

The resulting planar cake is then dried by conventional powder metal drying methods to remove essentially all the liquid therefrom, the methods being selected to reduce or eliminate cracking during drying. Any organic binders which may be present are removed by standard dewaxing techniques.

At this point if the liquid medium of the slurry has been water or an oxygen containing organic solvent, oxygen must be removed from the cake. This is done by heating the cake in hydrogen at a temperature sufficient to reduce any metal oxides which are present to their respective metals but below the normal sintering temperature of any metal contained therein. By "normal sintering temperature" is meant the temperature at which the cake is sintered to the final desired density. A minor amount of sintering can take place at this point and this is advantageous because it strengthens the cake and it is easier to handle if handling is necessary. This temperature is most typically from about 800° C. to about 1000° C. The time of heating depends of factors as the temperature, size of charge, thickness of the cake, nature of the equipment, etc. This step can be done separately or as part of the sintering operation.

The resulting dried and heated cake is then sintered by well known methods to a density at or near the theoretical density. This is considered to be equal to or greater than about 90% of the theoretical density of the alloy. Depending on the application and on the composition, the cake can be solid state or liquid phase sintered to form the sheet. For example, if the sheet is to be rolled, it is necessary to get the density to at least about 90% to about 93% of the theoretical. With a weight composition consisting essentially of about 7% Ni, about 3% Fe, and about 90% W, solid state sintering would be sufficient. Sintering temperatures and times depend on the nature of the alloy and on the density desired for the specific application. Typically, the solid state sintering temperature is from about 1400° C. to about 1430° C. Liquid phase sintering is preferable for better rolling, higher density and healing of cracks which can form during drying. Densities of about 99.4% of theoretical have been achieved in practice. Usually liquid phase sintering results in a more uniform composition of the alloy components throughout the sheet. The liquid phase sintering temperature is above the solidus temperature of the matrix phase of the alloy but below the melting point of tungsten.

The resulting sheet can now be processed by known methods of hot rolling and annealing to form the final size sheet. However, when the process of the present invention is followed to produce a sheet which is close to the desired final thickness, less rolling and annealing are required than with sheets formed by prior art methods. This is because the cake has been formed to a size very close to the desired size of the final sheet.

To more fully illustrate this invention, the following nonlimiting example is presented.

EXAMPLE

This example is a comparison of how a sintered preform mad e by prior art methods is rolled to final dimensions versus a preform sheet made by the process of the present invention.

| Prior art method Sintered preform (cold isostatic press and sinter) | This invention Sintered preform |
|---|---|
| 1" thick | 0.1786" thick |
| Heat treat | Heat treat |
| Roll to reduce to 0.7" thick (30% reduction) | Roll to reduce to 0.125" (30% reduction) |
| Anneal (1 hr) | Heat treat |
| Roll to reduce to 0.49" thick (30% reduction) | Trim to size |
| Anneal (1 hr) | |
| Roll to reduce to 0.343" thick (30% reduction) | |
| Anneal (1 hr) | |
| Roll to reduce to 0.240" thick (30% reduction) | |
| Anneal (1 hr) | |
| Roll to reduce to 0.168" thick (30% reduction) | |
| Anneal (1 hr) | |
| Roll to reduce to 0.125" thick (26% reduction) | |
| Heat treat | |
| Trim to size | |

It can be seen that by the process of the present invention in forming the preform sheet, a number of rolling and annealing steps are eliminated.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing a sheet of tungsten heavy alloy, said process comprising:

(a) uniformly blending elemental metal powder components of said alloy by forming a slurry of powders of iron, nickel, and tungsten in a weight ratio suitable for forming a tungsten heavy alloy in a liquid medium selected from the group consisting of water, alcohols, alkane hydrocarbons, chlorinated hydrocarbons, and mixtures thereof;

(b) removing said liquid medium from said powders and forming a planar cake of said powders;

(c) drying said cake; and (d) sintering said cake to a density equal to or greater than about 90% of the theoretical density of said alloy to form said sheet.

2. A process of claim 1 wherein the dried cake before the sintering step is heated in hydrogen at a temperature sufficient to reduce any metal oxides which are present to their respective metals but below the sintering temperature of any metal contained therein.

3. A process of claim 2 wherein said temperature is from about 800° C. to about 1000° C.

* * * * *